United States Patent [19]

Rougier

[11] 4,299,347

[45] Nov. 10, 1981

[54] DEVICE FOR REMOVAL OF CASTING DEADHEAD BY HYDRAULIC WEDGE

[75] Inventor: Jean-Paul Rougier, Lanester, France

[73] Assignee: Societe Bretonne de Fonderie et de Mecanique (S.B.F.M.), Lanester, France

[21] Appl. No.: 72,694

[22] Filed: Sep. 5, 1979

[30] Foreign Application Priority Data

Apr. 4, 1979 [FR] France ..... 79 08498

[51] Int. Cl.[3] ..... B26F 3/00

[52] U.S. Cl. ..... 225/97; 225/103; 254/104; 299/23

[58] Field of Search ..... 254/104; 299/23; 225/97, 103

[56] References Cited

U.S. PATENT DOCUMENTS

| | | | |
|---|---|---|---|
| 2,093,452 | 9/1937 | Joy | 254/104 UX |
| 2,225,852 | 12/1940 | Acordi | 299/23 |
| 2,328,661 | 9/1943 | Maloney | 254/104 X |
| 2,385,753 | 9/1945 | Young | 254/104 UX |
| 2,497,836 | 2/1950 | Miller | 254/104 X |
| 2,657,904 | 11/1953 | Evenson | 254/104 |
| 2,690,323 | 9/1954 | Evenson | 254/104 |
| 4,130,270 | 12/1978 | Andersson | 254/104 |
| 4,221,315 | 9/1980 | Latchague | 225/97 |

*Primary Examiner*—R. L. Spruill
*Assistant Examiner*—J. Reed Batten, Jr.
*Attorney, Agent, or Firm*—Oblon, Fisher, Spivak, McClelland & Maier

[57] ABSTRACT

The invention concerns a device permitting the separation of a casting piece from a casting deadhead to which it is joined. A pair of jaws are removably joined to a base and are slidable against a central wedge by dovetail surfaces.

1 Claim, 3 Drawing Figures

DEVICE FOR REMOVAL OF CASTING DEADHEAD BY HYDRAULIC WEDGE

BACKGROUND OF THE INVENTION

1. Field of the Invention

The present invention is in the area of casting. It aims at a device which will permit the separation of a casting piece from the deadhead to which it is linked.

2. Description of the Prior Art

Separation of the casting deadhead is a frequent operation in casting. The present invention aims at supplying a portable device permitting one to carry out this operation more quietly and without shocks, while avoiding errors.

SUMMARY OF THE INVENTION

The device for removal of the casting deadhead according to the invention is composed of two jaws, linked by a system of links to an exit clamp of a body of a hydraulic screw jack, whose piston is joined by its free end to a sliding mounted wedge, which slides between the two jaws so as to cause their separation almost immediately at the time of action of said screw jack.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

Figure 1:
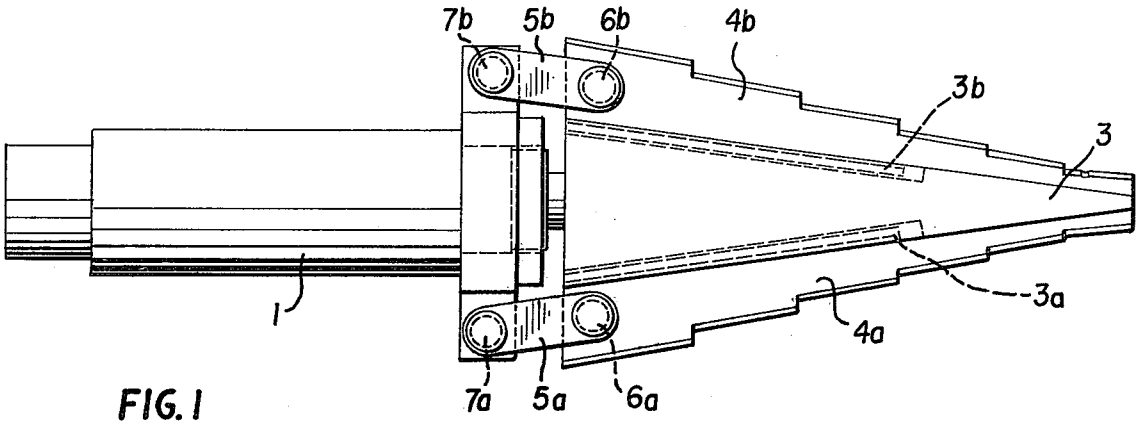
FIG. 1 is a side view of a device for separation of the casting deadhead according to the invention at rest.
Figure 2:
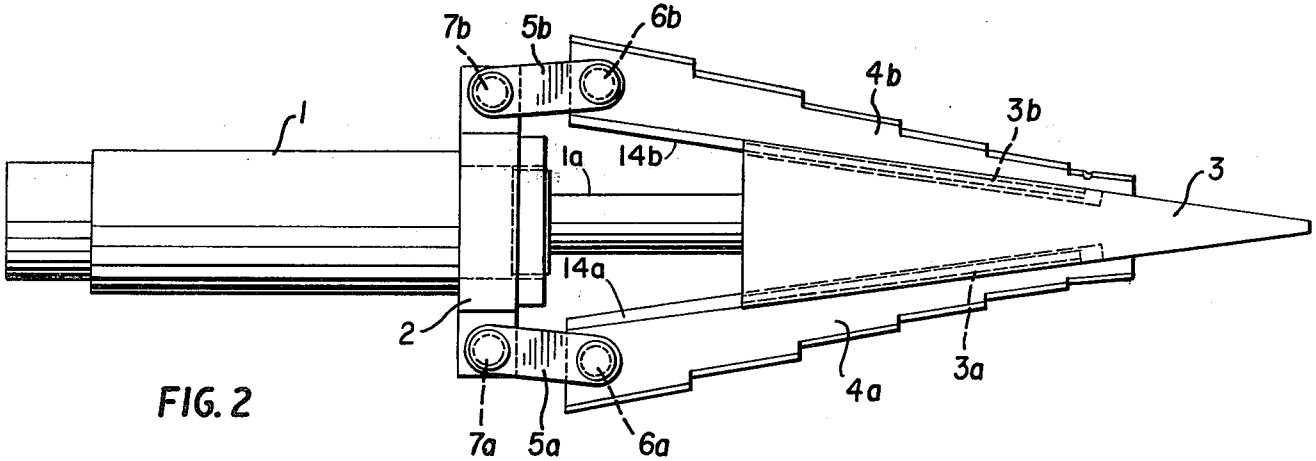
FIG. 2 is a side view of the device for separation of the casting deadhead of FIG. 1 in operation.

The device for separation of the casting deadhead according to the invention is composed of a mounted wedge 3, sliding between two jaws 4*a*, 4*b*, with each one connected by a system of links 5*a*, 5*b* and pins, 6*a*, 6*b*, 7*a*, 7*b* to a transverse support means such as an exit clamp 2, of a body or cylinder of a screw jack, 1, whose rod end, 1*a*, is joined to the base of the wedge, 3.

On the internal surface of the jaws, 4*a*, 4*b* are, respectively, dovetailed supports, 14*a*, 14*b* designed to slide into the longitudinal hollows of corresponding form, 3*a*, 3*b*, on the bevelled surfaces of the wedge 3.

At the time of operation of the screw jack, the jaws, 4*a*, 4*b*, placed between the casting deadhead and the casting piece (not shown in the drawings) are immediately and forcefully separated under the action of the wedge, 3, with the speed of separation of the jaws increasing due to the fact that the jaws, 4*a*, 4*b* are drawn back by the links, 5*a*, 5*b*, and these open equally by drawing said jaws toward the rear. It will be noted that the operation happens quietly and smoothly, while permitting one to easily break the sections of the necks of casting dead-heads of 100 mm in diameter thanks to the gear reduction due to the force of the wedge, although there is theoretically no opposition to breaking casting deadheads of a diameter greater than 100 mm.

The casting deadhead always breaks at the desired place, i.e. at its junction channel with the casting piece. This constricted area at the base of the casting deadhead, always hotter at the time of casting, includes in effect a more fragile coarse grain structure. This fragility is often reinforced by rupture bits called in casting "chamfering of breaking."

When the arrangement of the piece and deadhead does not permit a direct application of the wedge by the jaws touching both the piece and deadhead, jaws adapted to create a wedging effect, and elongated to have support on the piece based upon the form and arrangement of the piece, are used.

Figure 3:
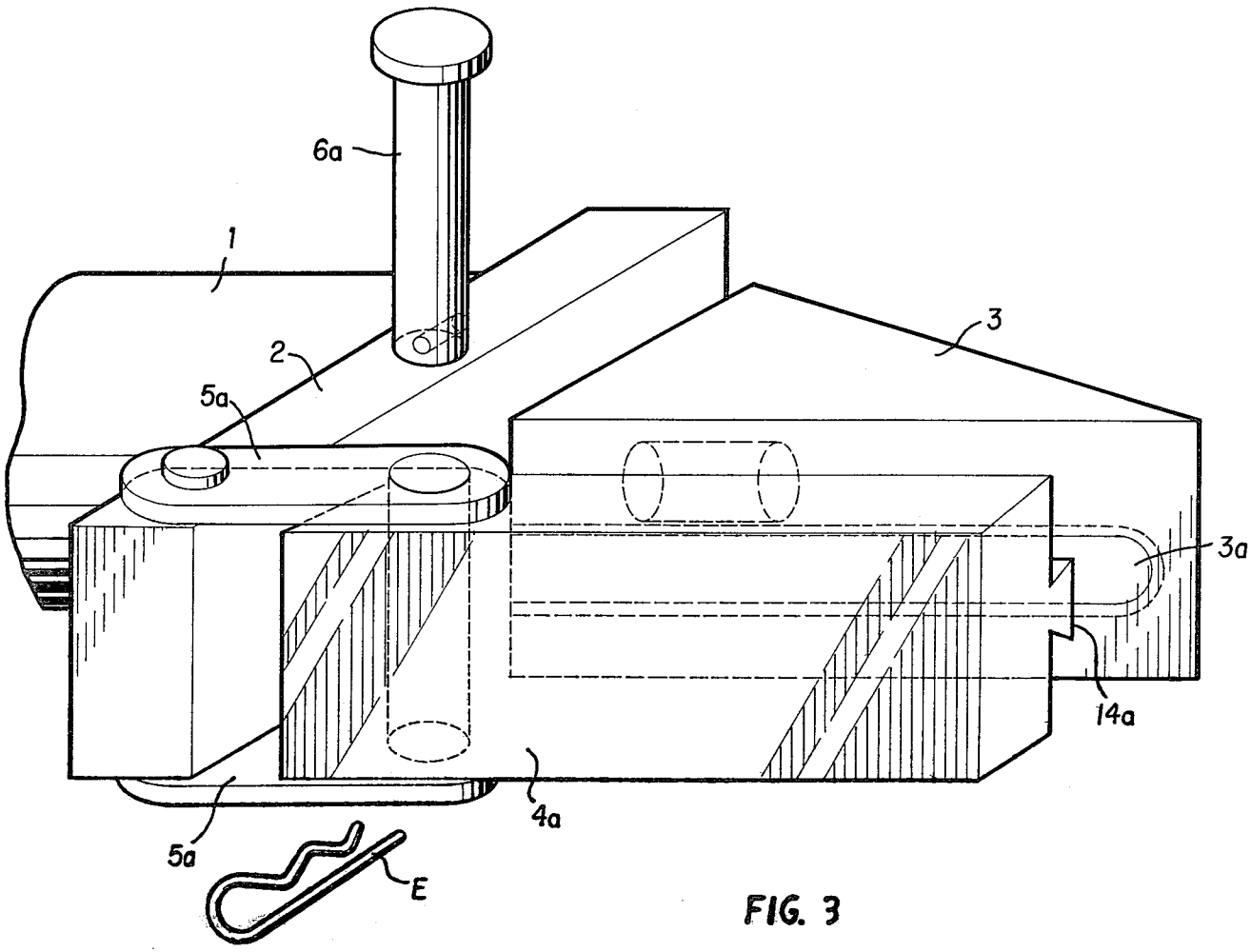
FIG. 3 is a partial perspective view, broken out, of a device for separation of the casting deadhead according to the invention.

The jaws are changed very easily by detaching the axis which joins them to the link. This operation, shown in detail schematically in FIG. 3, occurs according to the following process:

(a) one removes the pin, E, which is for example of the pin type used in agricultural tractors (this pin is nevertheless not necessary if the apparatus is always used horizontally; the pins or dowels, 6*a* and 6*b*, are then held by gravity);

(b) one removes the dowels 6*a*, 6*b*;

(c) one separates the two links, 5*a*, 5*b* (these may be joined in rotation to simplify the operation of replacing the dowel);

(d) one turns the wedge-jaw unit by ($\pi/2$ (the unit is joined to the hydraulic piston which turns naturally in the cylinder);

(e) one removes the jaw, 4*a*, toward the rear, by sliding the element, 14*a*, out of its housing, 3*a*;

(f) one introduces the new jaw from the rear toward the front, then after having replaced the wedge-jaw unit in its beginning position, one bolts the dowels, 6*a* and 6*b* again.

This operation requires about twenty seconds, which is another appreciable advantage of the device of removal of a casting deadhead according to the invention.

Obviously, numerous modifications and variations of the present invention are possible in light of the above teachings. It is therefore to be understood that within the scope of the appended claims, the invention may be practiced otherwise than as specifically described herein. What is claimed as new and desired to be secured by letters patent of the United States is:

1. An apparatus for separating a casting piece from a casting deadhead, said apparatus comprising:

a hydraulic screw jack having a body and a piston;

support means transverse to an end of said body;

a wedge mounted on the distal end of said piston;

a pair of jaws sliding against said wedge, one end of each of said jaws connected to said support means on said body of said jack through intermediate links wherein the sliding surface of each of said jaws includes at least one dovetail support and the sliding surfaces of said wedge include corresponding longitudinal hollows, said dovetail supports sliding in said hollows; and means for detaching said jaws from said links;

whereby the sliding of said jaws against said wedge causes their immediate separation.

* * * * *